United States Patent [19]

Huffman

[11] 4,274,456

[45] Jun. 23, 1981

[54] APPARATUS FOR DISPENSING FLUID SEALANT

[75] Inventor: Stanley S. Huffman, Golden, Colo.

[73] Assignee: Coors Container Company, Golden, Colo.

[21] Appl. No.: 100,847

[22] Filed: Dec. 6, 1979

[51] Int. Cl.[3] ..... B65B 43/42

[52] U.S. Cl. ..... 141/157; 141/165; 141/270; 53/290

[58] Field of Search ..... 53/412, 420, 423, 290, 53/381 A; 141/129, 144–162, 168, 250–284, 1–8, 37–67, 165, 369–378; 222/52, 70, 71

[56] References Cited

U.S. PATENT DOCUMENTS 3,604,178 9/1971 Bluhm ..... 53/412

*Primary Examiner*—Houston S. Bell, Jr.

*Attorney, Agent, or Firm*—Bruce G. Klaas; Richard D. Law; Dennis K. Shelton

[57] ABSTRACT

An apparatus for accurately dispensing predetermined amounts of fluid sealant onto can ends which comprises a dispenser arm mounted at one end for horizontal and vertical arcuate movement, a clamp for releasably holding the arm in one operative position, a can end hold down located on said dispenser arm and capable of reciprocal and rotational movement, and a proximity sensor responsive to the reciprocal movement of said can end hold down to generate a control signal when the can end hold down is approaching the apex of its reciprocal movement and dispenser mounted on said dispenser arm proximate to said can end hold down and capable of dispensing a predetermined amount of fluid sealant onto a can end in a predetermined location in timed response to the signal from said proximity sensor.

8 Claims, 5 Drawing Figures

APPARATUS FOR DISPENSING FLUID SEALANT

BACKGROUND AND SUMMARY OF THE INVENTION

This invention relates to a new and improved apparatus for dispensing a predetermined amount of fluid sealant into a can end recess for subsequent air tight attachment to a metallic can body in the manufacture of beverage containers and the like.

The current state of the art for applying a uniform bead of sealant to a can end member on a high speed production line for can ends, has progressed to the point of utilizing available electro pneumatic nozzles attached to mechanical support devices which are mounted in relatively fixed positions. The actuation of the dispensing of fluid sealant has generally been accomplished by means of an assembly which senses the proximity of the can end to the dispensing nozzle, when the can end is being rotated. Fluid sealant is then dispensed as the can end groove for receiving the sealant is rotated underneath the dispensing nozzle.

Adjustment of the proximity sensing device and the positioning of the arm is critical to the high speed operation of such a device. In the past, the proximity of the can end to the dispensing nozzle was sensed by the movement of a rocker arm assembly, which physically engaged the top of a can lid hold down pad shaft. As is customary with such devices, a considerable amount of play could develop requiring constant adjustment and attention thus decreasing the overall output of can ends from a production line incorporating such a device. The result of improper adjustment would be the dispensing of too much sealant or not enough sealant to accomplish the purpose for which the sealant is used. The subsequent container assembled from the can end might then not be properly sealed which could cause premature spoilage of the contents where perishable. In the same manner, the improper location of the nozzle over the can end being spun may cause the sealant to be placed in the wrong location of the can member, i.e., on portions of the can end other than the intended groove or recess, thus defeating the proper sealing function when the groove is subsequently attached to the open end of a can body.

It can be seen, therefore, that it is of critical importance that the positioning of a dispenser for fluid sealant over the groove in a can end be accurately and repeatedly accomplished. Likewise, the apparatus for providing the precise location should be capable of being serviced easily and returned to its operative position with a minimum of time spent for adjustment of the apparatus.

It is also highly desirable that a preferred apparatus for dispensing fluid sealant include as an integral portion thereof further apparatus for sensing can end proximity, which eliminates the drawback of complicated mechanical linkage which, as previously discussed, is prone to certain deficiencies in use.

Further, it is desirable to reduce the number of external pipes and lines servicing the dispenser gun and the controls for actuation of the flow of fluid sealant from the dispenser gun. External lines only tend to make repair and adjustment cumbersome by their presence and are prone to abuse and frequent repair or replacement during the operation of a high speed can end fabricating operation.

The present invention aims to eliminate most of the aforementioned problems by providing an apparatus which is capable of firmly supporting a fluid dispensing gun which is actuatable by improved can end sensing means, both of which are mounted on a support arm which is firmly located as to lateral position, but supported at its extremity by both horizontal and vertical pivoting means to enable the arm when serviced to be removed from its operative position over the can end to a position sufficiently removed from the work station to facilitate adjustment, cleaning or the like when required, and then simply and easily returned to a precise location for subsequent use.

These advantages are accomplished by providing a base plate positioned on a work table adjacent the can end feed transport means which will generally be bringing can ends from a stamping press. The base plate has mounted thereon pivoting means for supporting a dispenser arm that permits arcuate movement of the dispenser arm in both the horizontal and vertical planes, and clamping means for positioning the dispenser arm in a predetermined location generally transverse to the can end feed direction. The dispenser arm of the present invention contains at the end opposite the pivot means, a can end hold down pad assembly comprising, proximity sensing means responsive to actuation by the upward vertical engagement of a can end by reciprocal means located in the can end feed path, which reciprocal means moves the can end upward against the hold down pad of the assembly of the present invention while the can end is being rotated, electro-pneumatic means also mounted on the dispenser arm and responsive to the signal generated by the proximity sensing means for providing pneumatic pressure to preferrably lift a needle valve within a sealant dispenser gun to permit the discharge of fluid sealant from a supply under pressure, out through the nozzle of the dispenser gun and into the groove of the rotating can end. The speed of rotation and time of sealant discharge are adjustable to coincide with exactly one revolution of the can end under the dispensing gun while sealant is being discharged.

Accordingly, by use of the apparatus of the present invention, sealant can be properly applied to can ends on a can end feed transport means at each station equipped with the apparatus herein described at rates in excess of 400 can ends per minute.

DETAILED DESCRIPTION

Figure 1:
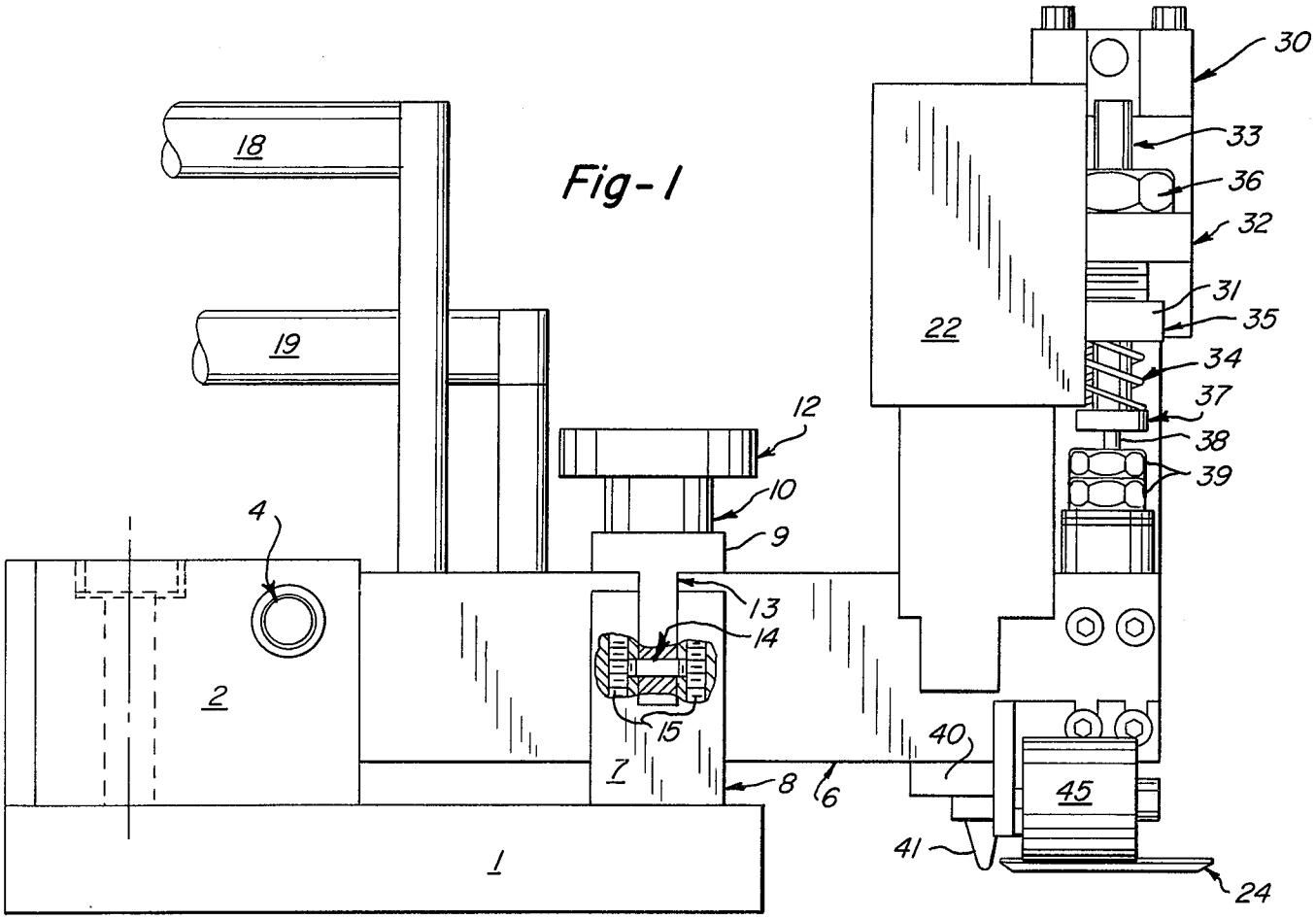
FIG. 1 is a side elevational view in line drawing and partly in cross-section, of an illustrative embodiment of the apparatus of the present invention.

Referring now to FIG. 1, in general, the apparatus of the present invention comprises a base plate 1 to which is mounted a pivot block 2 having located thereon a vertical pivot enabling the pivot block 2 to rotate about the vertical axis of the pivot. The dispenser arm 6 is received in a recess 5 in pivot block 2, shown in FIG. 3 and in the location where horizontal pivot 4 communicates through dispenser arm 6 in a manner to permit dispenser arm 6 to be rotated about horizontal pivot 4 in an upward arc.

Figure 2:
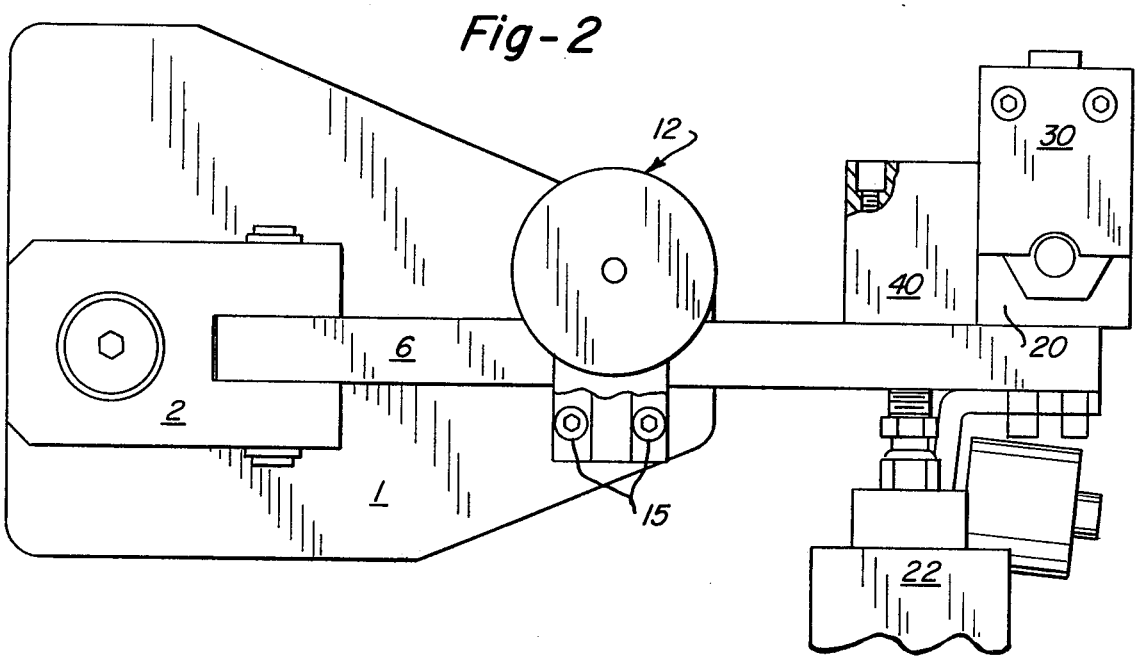
FIG. 2 is a partial plan view of the apparatus of FIG. 1.
Figure 3:
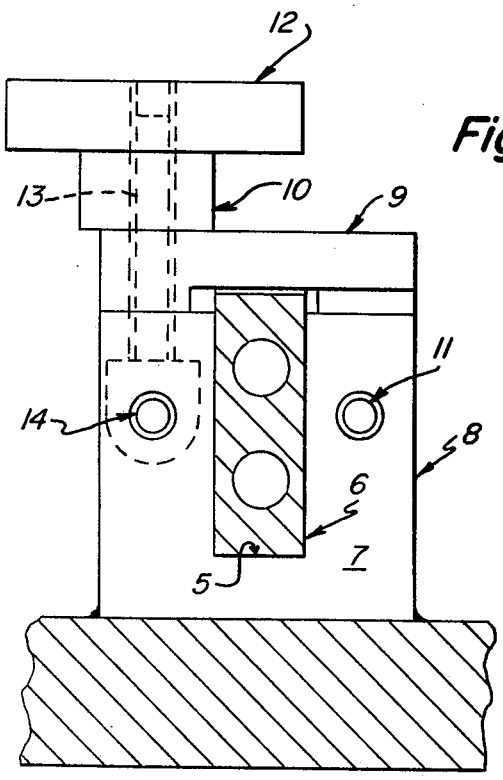
FIG. 3 is an enlarged partial cross-sectional view of a portion of the apparatus of FIG. 1.
Figure 4:
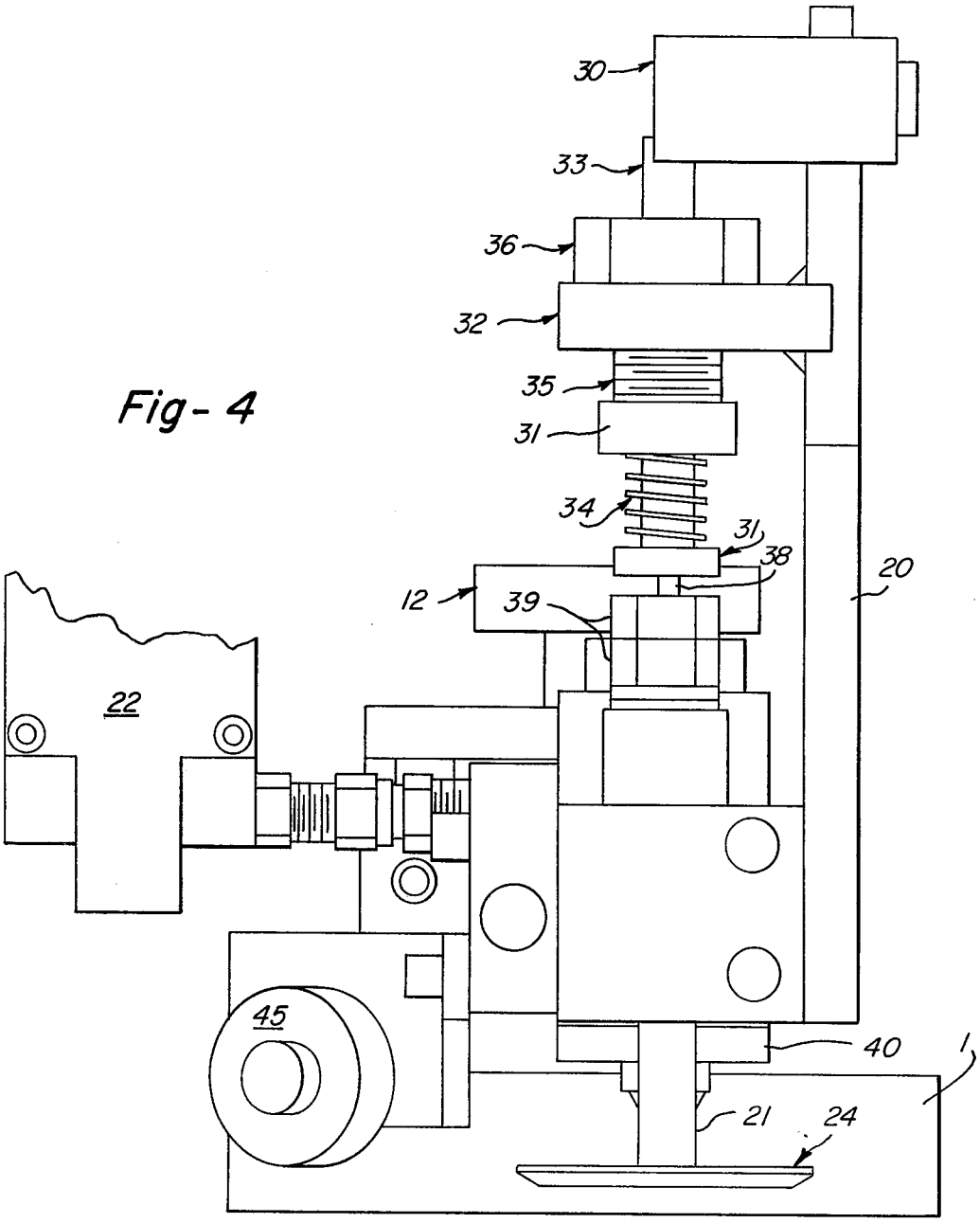
FIG. 4 is a partial end view, partly in cross-section, of the apparatus of the present invention.

Clamp 7 located on base plate 1 centrally of dispenser arm 6 is attached to base plate 1 via machine screws 15, and is shown in greater detail in FIG. 2. Referring to FIG. 3, the clamp 7 for holding support arm 6 is composed of a support block 8 containing a recess for receiving, in close tolerance and in a generally horizontal position, the dispenser arm 6. Dispenser arm 6 is held in this position by the action of hinge block 9 and swing bolt 13. Hinge block 9, an inverted L shaped member, has the lower leg disposed in a recess (not shown) in support block 8. Hinge pin 11 is disposed horizontally through support block 8, the recess, and perpendicular to and communicates through the downward pointing arm of hinge block 9. Hinge pin 11 provides an axis about which the hinge block 9 can be rotated upward sufficiently to permit dispenser arm 6 to be received in recess 5 of support block 8. Likewise, hinge block 9 in its operative clamping position will be rotated so that the horizontal arm of the inverted L will engage the top most portion of dispenser arm 6 holding it firmly into recess 5 of support block 8. The clamping action of hinge block 9 is provided by the swing bolt 13, bushing 10 and internally threaded knob 12. Hinge block 9 is constructed with a U-shape recess in the upper arm of the inverted L so as to receive a swing bolt 13 which is pivoted via swing bolt pivot 14 to provide freedom of movement from the vertical position shown in FIG. 3 to a horizontal position away from engagement with hinge block 9 (not shown) allowing hinge block 9 to be rotated about hinge pin 11 for either receiving dispenser arm 6 or lifting dispenser arm 6 out of the recess 5 in support block 8. The clamping action of swing bolt 13 is provided by bushing 10, acting as a spacer, and the action of threaded knob 12. When threaded knob 12 is tightened against bushing 10, bushing 10 is forced against hinge block 9, as shown in FIG. 3, and vertical movement of dispenser arm 6 is prevented. With dispenser arm 6 in its horizontal position as shown in FIGS. 1 and 2, the distal end of dispenser arm 6, ie. the end opposite the pivot block 2, contains mounted thereon a hold down pad bracket 20, a solenoid 22 and a fluid sealant dispenser gun 40.

The hold down pad bracket 20 will preferably be comprised of a vertical base and a shelf 32 which is threaded to receive a plunger assembly 31 comprising a threaded plunger guide 35 and a plunger guide nut 36, and having received in the plunger guide 35 a plunger 33 which is spring biased vertically downward by spring 34 acting against plunger guide 35 and plunger seat 37. Plunger seat 37 has disposed on the face thereof a downwardly protruding dowel 38 which is engaged by a recess in the end of hold down pad shaft 21 which extends upwardly from the hold down pad 24. The hold down pad shaft 21 is threaded at its top most extremity to engage lock nuts 39 which prevent unrestricted downward movement of hold down pad 24 and its accompanying shaft but is unrestricted as to upward movement until engaging dowel 38.

Hold down pad bracket 20 also contains at its uppermost extremity a proximity sensor 30 which responds to the upward movement of plunger 33 by producing an electrical signal.

Dispenser arm 6 is also provided with internal conduits or channels, communicating there through (as shown in the cross-sectional view of dispenser arm 6, FIG. 3) which communicate with an air line 18 and a fluid sealant supply line 19. Air line 18 communicates through a channel provided in dispenser arm 6 with solenoid 22. Likewise, fluid sealant line 19 communicated through another channel in dispenser arm 6 with a dispenser gun 40. The supply of fluid sealant is under pressure from a pressure source and reservoir (not shown) and is dispensed through the nozzle 41 of dispenser gun 40 by the application of air pressure to solenoid 22 which when actuated by the control circuitry 60 (FIG. 5) in response to a signal from proximity sensor 30, allows the air under pressure from the air line 18 to be applied to a chamber inside of dispenser gun 40 whereby a piston is raised inside dispenser gun 4 (not shown) to which is attached a needle valve (not shown), causing it to rise, opening an outlet in the lower tip of nozzle 41 to permit the fluid sealant under pressure in line 19 to be dispensed in a predetermined manner from the discharge nozzle 41.

Operation

Figure 5:
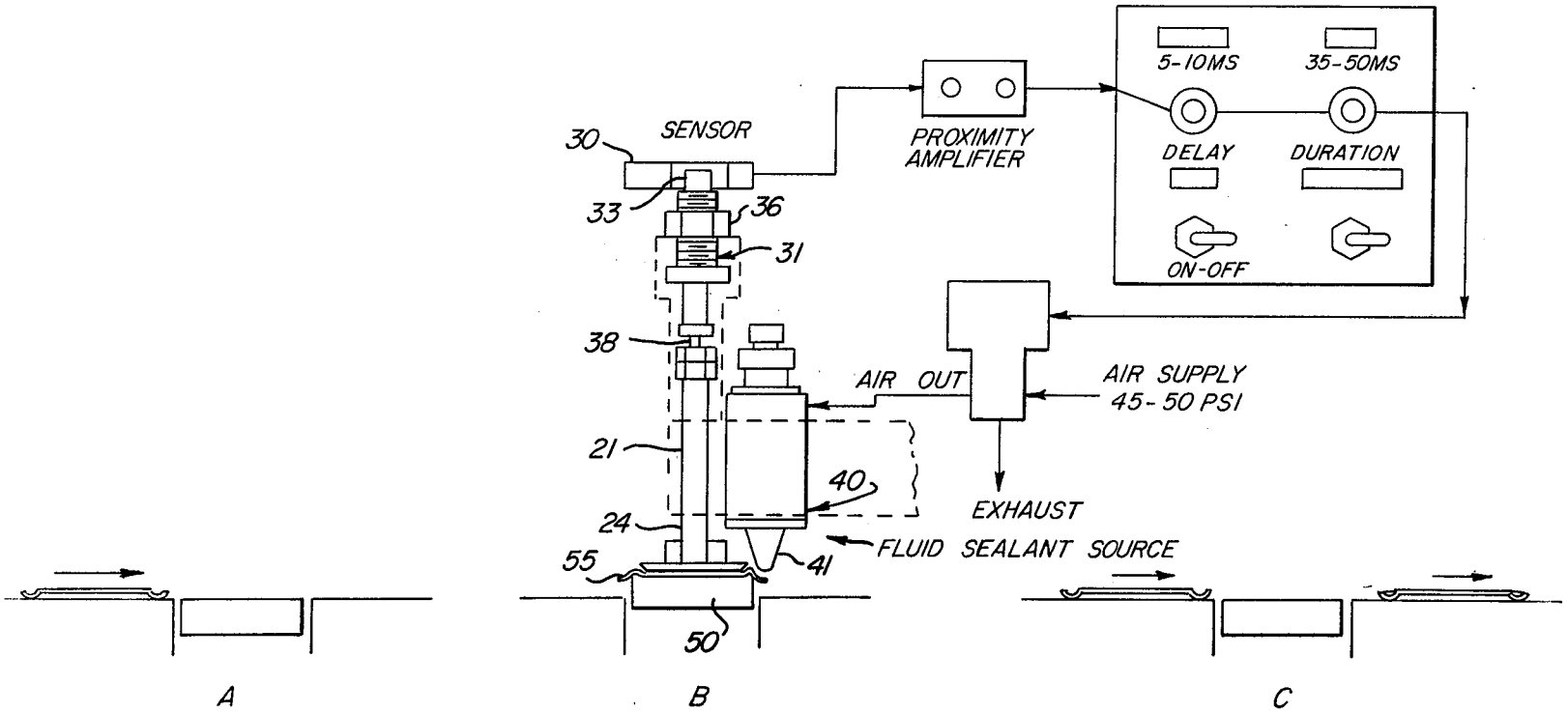
FIG. 5 is a schematic view of the controls and sequence of operation of the apparatus of the present invention.

Referring now to FIG. 5 the sequence of operation of the apparatus according to this invention will be more fully understood. Generally, the apparatus of the present invention will be located so that the hold down pad 24 is positioned in vertical alignment with a can end pathway which normally utilizes means for engaging the sides of the can ends and moving them along the pathway from a source of stacked ends to a stationary position on a reciprocally moving rotating work station 50 as shown in FIG. 5*a*. The can end is presented to the work station 50 by linear movement along the pathway. When the can end 55 is positioned by the pathway transport means (not shown) onto work station 50 then work station 50 is rotated and cam actuated upwardly to engage the can end 55 with the hold down pad 24. As the combination of work station 50, can end 55, and hold down pad 24 are vertically displaced upwardly the recess in the upper end of shaft 21 engages the dowel 38 of plunger assembly 31 displacing the plunger 33 upwardly into the proximity of the sensor 30. Sensors suitable for use include Sensor No. 4943D 0379 by Electro Products of Sarasota, Florida. If the proper adjustments as to height and length of travel have been made to the plunger guide nut 36 and the position of the threaded portion of plunger assembly 31 on hold down pad bracket shelf 32 (shown in FIG. 1), the proximity sensor 30 will generate a signal which will be amplified by a proximity amplifier and fed electrically to a control box 60 (such as Nordson Corp. Timer Model No. CT6) containing adjustments as to delay in the onset of solenoid actuation and the duration of actuation and the output of the control box 60 will be the input to the solenoid valve for it to allow a supply of air at preferrably about 45–50 p.s.i. to be applied to a piston within dispenser gun 40 raising a needle type valve within nozzle 41 permitting the flow of fluid sealant from the nozzle 41 into the annular groove of the can end illustrated while the work station 50 is rotating and approaching and departing its uppermost position. Solenoid valves such as No. 255B-610E by Mac Valves, Inc. of Wixom, Michigan have been found to be suitable for this application. The time delay for the onset of application of air pressure to the dispenser gun 40 and the duration of air supply responsive to a signal from sensor 30 is adjusted to correspond to one full revolution of the work station 50 as it nears its uppermost position and begins its travel back into registry with the pathway for the can ends. At C in FIG. 5 the can end with sealant will be displaced by transport means (not shown), placing another can end without sealant onto work station 50 while it is in registry with the pathway. The same sequence of operation previously described is then repeated. In addition, hold down pad 24 and hold down pad shaft 21 can be provided with a collar 42 for limiting the upward travel of the hold down pad to prevent damage to the apparatus in the event of a failure of the plunger assembly to hold position due to the backing off of plunger guide nut 36 or failure of the spring or breakage of dowel pin 38 or the like. This collar 42 will also prevent accidental engagement of the can end with the dispenser air nozzle 41 which could damage the nozzle and require service of the apparatus.

In the practice of the present invention, it is contemplated that the fluid sealant used can be the conventional latex and clay composition used normally for beverage applications, however, any other suitable sealant can be used which will flow under pressure and provide the necessary sealing function particularly for food grade containers. It is also contemplated that conventional electro-pneumatic dispensing guns can be used, such as those provided by the Nordson corporation of Amherst, Ohio, (for example, Compound Gun No. A11A 709570) which typically are connected to a sealant supply under a pressure of from between sixty and ninety pounds per square inch pressure with the composition temperature maintained in the range of from about 90° F. to about 110° F.

It has been found by the use of the apparatus of the present invention that a more uniform application of sealant to can end recesses is accomplished with a minimum of so-called pigtail curl, which is excess sealant and, therefore, waste. This means there is a reduction in cost from excess sealant application and from scrap created by improper sealing. In addition, the apparatus of the present invention can, when properly adjusted, maintain a rate of operation in an excess of four hundred can ends per minute, with a minimum of down time for readjustment of the apparatus, thereby producing further economies in the operation of applying sealant to can ends.

It can be seen from the foregoing that the apparatus of the present invention can be utilized in a wide variety of applications not limited to application of sealant to beverage can ends. It is intended that the claims be construed to include alternative embodiments of the inventive concepts disclosed herein except insofar as limited by the prior art.

What is claimed is:

1. An apparatus for repeatably dispensing predetermined amounts of fluid sealant accurately into an annular recess of separately presented can end articles comprising:

a dispenser arm pivotally mounted at one end thereof for horizontal and vertical arcuate movement;

releasable clamping means located centrally of said dispenser arm for accurately positioning said dispenser arm in a horizontal plane;

can end engaging means, including;

a rotatable vertically reciprocating member located at the end of said dispenser arm opposite the pivot mounting end, for engaging a rotating upwardly moving can end;

electronic sensing means responsive to the vertical movement of said rotatable vertically reciprocating member to sense when the can end is vertically proximate to said dispenser arm; and dispensing means mounted on the dispensing arm proximate said can end engaging means and including a discharge nozzle aligned with the annular groove of a can end when said can end is engaged by said can end engaging means and said can end in its reciprocal vertical movement is proximate to said discharge nozzle, said dispensing means including means responsive to said electronic sensing means to discharge fluid sealant from said discharge nozzle into the annular groove of the can end when the can end is rotating and proximate the discharge nozzle of said dispensing means.

2. The apparatus of claim 1 wherein said dispensing means communicates with a source of fluid sealant under pressure.

3. The apparatus of claim 1 wherein said dispensing means includes electrically actuated valve means responsive to said electronic sensing means for controlling the flow of fluid sealant from the dispensing means.

4. The apparatus of claim 1 wherein the dispenser arm is provided with channels to provide air tight communication between a source of fluid sealant under pressure and the dispensing means and between a source of fluid under pressure and said dispensing means for discharging fluid sealant from said discharge nozzle.

5. An apparatus for dispensing predetermined amounts of fluid sealant comprising:

a dispenser arm member, including first and second end portions, and being mounted near a first end to a supporting surface in a manner to provide for rotational movement of said arm about two axes;

clamping means for locating said dispenser arm in a predetermined position in a manner to prevent movement of said dispenser arm;

dispensing means mounted near a second end portion of said dispenser arm and including a fluid sealant dispenser containing a discharge nozzle and dispenser valve means in said discharge nozzle, said dispenser valve means being normally closed and actuated to open by air pressure and close by the release of air pressure, to alternatively permit and restrict the discharge of fluid sealant from said discharge nozzle;

air valve means for controlling the introduction of air pressure to said dispenser valve means; and a plurality of conduit means located within said dispenser arm member communicating with a source of air pressure external to said dispenser arm and said air valve means attached to said dispenser arm and, a source of fluid sealant external to said dispenser arm and said fluid sealant dispenser attached to said dispenser arm whereby predetermined actuation of said air valve will actuate said dispenser valve means within said fluid sealant dispenser and fluid sealant will be discharged from said discharge nozzle according to the motive force applied to the fluid sealant being supplied from the source of fluid sealant.

6. The apparatus of claim 5 further comprising hold down pad means located on said dispenser arm member near the second end portion thereof for holding can end members substantially parallel to said dispenser arm and in predetermined vertical registry with said discharge nozzle whereby discharge of fluid sealant from said fluid sealant nozzle will be deposited at a predetermined location on said can end.

7. The apparatus of claim 6 wherein said hold down pad means incorporates electronic means for actuating said air valve means.

8. The apparatus of claim 7 wherein said electronic means includes:

delay circuits responsive to predetermined actuation by the proximity of a can end to said discharge nozzle; and duration circuits responsive to the output signal from said delay circuit and capable of producing an output which can actuate said air valve means, whereby the starting time for actuation of said air valve means and the duration of opening of said dispenser valve means can be adjusted to match the externally controlled speed of introduction of can ends to said hold down pad means and their discharge therefrom while providing for the application of fluid sealant to a predetermined location on said can end.

* * * * *